US010892559B2

(12) United States Patent
Farzaneh et al.

(10) Patent No.: US 10,892,559 B2
(45) Date of Patent: Jan. 12, 2021

(54) DIPOLE ANTENNA

(71) Applicant: GALTRONICS USA, INC., Tempe, AZ (US)

(72) Inventors: Sadegh Farzaneh, Kanata (CA); Minya Gavrilovic, Kanata (CA); Des Bromley, Kanata (CA); Jacco Van Beek, Kanata (CA)

(73) Assignee: GALTRONICS USA, INC., Tempe, AZ (US)

( * ) Notice: Subject to any disclaimer, the term of this patent is extended or adjusted under 35 U.S.C. 154(b) by 42 days.

(21) Appl. No.: 16/211,636

(22) Filed: Dec. 6, 2018

(65) Prior Publication Data

US 2019/0173186 A1 Jun. 6, 2019

Related U.S. Application Data

(60) Provisional application No. 62/595,274, filed on Dec. 6, 2017.

(51) Int. Cl.

| | |
|---|---|
| ***H01Q 9/20*** | (2006.01) |
| ***H01Q 9/06*** | (2006.01) |
| ***H01Q 21/24*** | (2006.01) |
| ***H01Q 21/26*** | (2006.01) |
| ***H01Q 1/24*** | (2006.01) |
| ***H01Q 5/378*** | (2015.01) |
| ***H01Q 5/40*** | (2015.01) |

(52) U.S. Cl.

CPC ..... *H01Q 9/20* (2013.01); *H01Q 1/246* (2013.01); *H01Q 5/378* (2015.01); *H01Q 5/40* (2015.01); *H01Q 9/065* (2013.01); *H01Q 21/24* (2013.01); *H01Q 21/26* (2013.01)

(58) Field of Classification Search

CPC .. H01Q 9/20; H01Q 9/22; H01Q 9/24; H01Q 21/26

See application file for complete search history.

(56) References Cited

U.S. PATENT DOCUMENTS

| | | | | |
|---|---|---|---|---|
| 2014/0139387 | A1* | 5/2014 | Jones | H01Q 21/30 343/794 |
| 2014/0240188 | A1* | 8/2014 | Mamo | H01Q 21/26 343/798 |
| 2015/0200460 | A1* | 7/2015 | Isom | H01Q 9/0407 343/853 |
| 2015/0295313 | A1* | 10/2015 | Zimmerman | H01Q 5/48 343/810 |
| 2017/0085289 | A1 | 3/2017 | Jan et al. | |
| 2017/0244176 | A1 | 8/2017 | Ming et al. | |
| 2018/0183134 | A1 | 6/2018 | Jan et al. | |
| 2018/0227775 | A1 | 8/2018 | Bisiules et al. | |
| 2019/0312337 | A1 | 10/2019 | Farzaneh et al. | |

* cited by examiner

*Primary Examiner* — Daniel Munoz

(74) *Attorney, Agent, or Firm* — Brion Raffoul

(57) ABSTRACT

A dipole antenna is disclosed herein. The dipole antenna may include, but is not limited to, a first transmission line configured to receive a radio frequency signal from a first feed, a first balun galvanically coupled to the first transmission line, a first conductive strip galvanically coupled to the first transmission line and the first balun, a second conductive strip galvanically coupled to the first transmission line and the first balun, a first dipole arm, and a second dipole arm, wherein the first balun and the first transmission line are only capacitively coupled to the first and second dipole arms via the first and second conductive strips.

18 Claims, 8 Drawing Sheets

DIPOLE ANTENNA

CROSS-REFERENCE TO RELATED APPLICATION(S)

This application claims the benefit of U.S. provisional patent application Ser. No. 62/595,274, filed Dec. 6, 2017, the entire content of which is incorporated by reference herein.

TECHNICAL FIELD

The present disclosure generally relates to antenna, and more particularly relates to dipole antennas.

BACKGROUND

Dipole antennas typically include a feed and two dipole arms or branches. The length of the dipole arms affect the frequency range in which the dipole antenna can radiate within. In some instances, the dipole antenna may include a balun to balance the current on both dipole arms.

BRIEF SUMMARY

In one embodiment, for example, a dipole antenna is provided. The dipole antenna may include, but is not limited to, a first transmission line configured to receive a radio frequency signal from a first feed, a first balun galvanically coupled to the first transmission line, a first conductive strip galvanically coupled to the first transmission line and the first balun, a second conductive strip galvanically coupled to the first transmission line and the first balun, a first dipole arm, and a second dipole arm, wherein the first balun and the first transmission line are only capacitively coupled to the first and second dipole arms via the first and second conductive strips.

In accordance with another embodiment, a dual polarized antenna is provided. The dual polarized antenna may include, but is not limited to, a first dipole antenna which includes, but is not limited to, a first transmission line configured to receive a radio frequency signal from a first feed, a first balun galvanically coupled to the first transmission line, a first conductive strip galvanically coupled to the first transmission line and the first balun, a second conductive strip galvanically coupled to the first transmission line and the first balun, a first dipole arm, and a second dipole arm, wherein the first balun and the first transmission line are only capacitively coupled to the first and second dipole arms via the first and second conductive strips, and a second dipole antenna which may include, but is not limited to, a second transmission line configured to receive a radio frequency signal from a second feed, a second balun galvanically coupled to the second transmission line, a third conductive strip galvanically coupled to the second transmission line and the second balun, a fourth conductive strip galvanically coupled to the second transmission line and the second balun, a third dipole arm, and a fourth dipole arm, wherein the second balun and the second transmission line are only capacitively coupled to the third and fourth dipole arms via the third and fourth conductive strips, and wherein the first dipole arm and the second dipole arm have a first polarization and the third dipole arm and fourth dipole arm have a second polarization different than the first polarization.

BRIEF DESCRIPTION OF THE DRAWINGS

The detailed description will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or detail of the following detailed description.

A dipole antenna is disclosed herein. In a typical dipole antenna having two radiating dipole arms, the radiating dipole arms are directly electrically connected (i.e., galvanically connected) to a balun and a feed. However, as discussed in further detail below, the radiating arms of the dipole disclosed herein are only capacitively coupled, and not galvanically coupled, to a balun. This arrangement allows the height of the dipole to be reduced, resulting in the dipole arms of the antenna being closer to a reflector, which has numerous advantages as discussed in further detail below.

Figure 1:
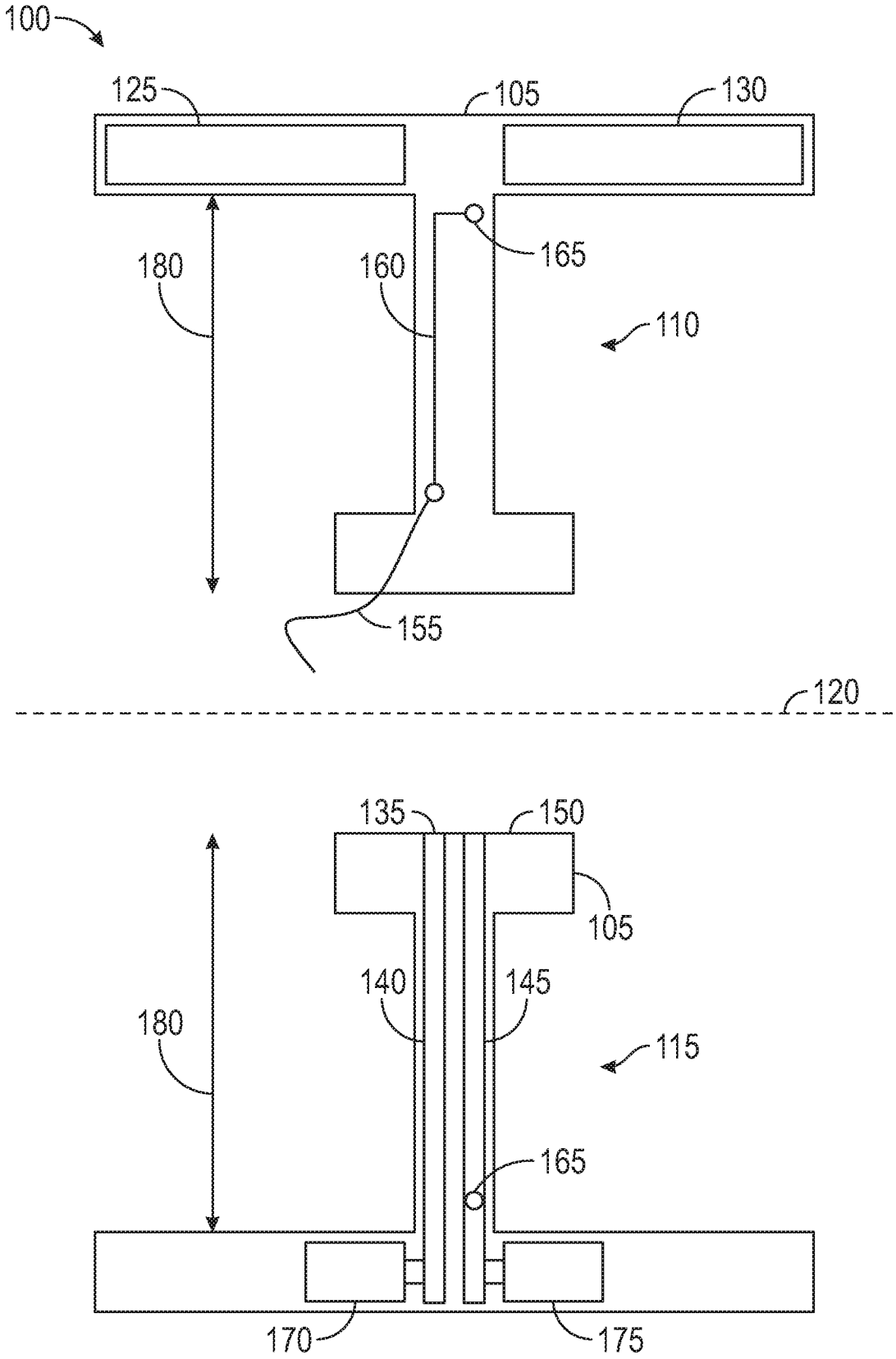
FIG. 1 illustrates a dipole antenna, in accordance with an embodiment.

FIG. 1 illustrates a dipole antenna 100, in accordance with an embodiment. The dipole antenna 100 is formed on two sides of a substrate 105. In one embodiment, for example, the substrate 105 may be a printed circuit board (PCB). However, the dipole antenna 100 may be formed from any known substrate using any known technique, including, but not limited to metal (e.g., stamped metal antenna or the like), coax, microstrip or the like. As seen in FIG. 1, a side 110 of the substrate 105 is illustrated on an upper half of FIG. 1 and a side 115 of the substrate 105 is illustrated on the lower half of FIG. 1. The side 115 of the substrate 105 is rotated one-hundred eighty degrees around axis 120 relative to the side 110.

The dipole antenna 100 includes a dipole arm 125 and a dipole arm 130 formed on the side 110 of the substrate 105. The length of the dipole arms 125 and 130 affect the frequency range at which the dipole antenna 100 radiates. In other words, by adjusting the length of the dipole arms 125 and 130, the dipole antenna 100 can radiate at different frequency ranges depending upon the application of the dipole antenna 100.

The dipole antenna 100 further includes a balun 135 formed on the side 110 of the substrate 105. In this embodiment the balun 135 is formed from a slotted line. In other words, the balun is formed from an electrically conductive strip 140 in parallel with an electrically conductive strip 145 separated by a non-conductive material (e.g., a dielectric on a PCB). In the embodiment illustrated in FIG. 1, the end 150 of the antenna is intended to be coupled to a ground plane (not illustrated), thereby galvanically connected the respective ends of the electrically conductive strip 140 to the electrically conductive strip 145. However, the electrically conductive strip 140 and the electrically conductive strip 145 could be coupled in other manners, such as via a direct electrical connection or the like.

A feed 155, such as a coaxial cable or the like, provides a radio frequency signal to a transmission line 160 formed on the side 110 of the substrate 105. The transmission line 160 may be, for example, a conductive strip on the substrate 105. The transmission line 160 couples to the electrically conductive strip 145 of the balun 135 through a via 165 which connects the sides of the substrate 105.

The electrically conductive strip 140 is galvanically coupled to a conductive strip 170 arranged on an opposite side of the substrate 105 as dipole arm 125. In other words, the conductive strip 170 is positioned on a portion of the side 115 of substrate 105 which overlaps at least a portion of the dipole arm 125 on the side 110 of the substrate 105, but is galvanically isolated from the dipole arm 125 via the substrate 105 between the them. Likewise, electrically conductive strip 145 is galvanically coupled to a conductive strip 175 arranged on an opposite side of the substrate 105 as dipole arm 130. When fed a radio frequency signal from the feed 155, the conductive strips 170 and 175 capacitively couple to the dipole arms 125 and 130, respectfully, causing the dipole arms 125 and 130 to radiate. By adjusting the area (i.e., the length and width) of the conductive strips 170 and 175, the amount of capacitive coupling between the dipole arms 125 and 130 and the conductive strips 170 and 175 can be adjusted. This allows the reactance of the dipole arms 125 and 130 to be controlled. The length of the conductive strips 170 and 175 is smaller than a resonant length for the dipole antenna 100, and, thus, the conductive strips 170 and 175 do not radiate themselves.

Using dipoles of this design allows for dipole antennas which are smaller in size while having a wider bandwidth. For example, the height of the antenna 100 can be reduced by utilizing a shorter balun 135. In one embodiment, for example, the height of the balun 135, as indicated by arrow 180, may be around twenty to thirty percent less than a dipole antenna which directly connects the dipole arms to a balun. However, the exact height reduction can vary as other parameters may contribute to a final desired height. Furthermore, in some embodiments, the length of the dipole arms 125 and 130 may need to be lengthened to compensate for the shorter balun 135. By having a shorter balun 135, the dipole arms 125 and 130 may be located closer to a reflector. In a traditional dipole design, when a dipole is located closer to a reflector, the antenna reactance increases in the lower part of the radiating band, reducing the performance of the antenna. By utilizing the capacitive coupling between the balun 135 and the dipole arms 125 and 130, and by controlling the capacitance value by adjusting the size of the conductive strips 165 and 170, the reactance of the antenna 100 is reduced in lower part of the band to compensate for the dipole arms 125 and 130 being closer to a reflector. Accordingly, the capacitive connection allows the antenna impedance to be matched to the feed 155 (for example, a fifty ohm coaxial cable) when the dipole arms 125 and 130 are close to reflector without sacrificing the performance of the antenna.

Furthermore, having the dipole arms 125 and 130 closer to a reflector has several other advantages. The shorter balun 135, and not being galvanically connected to dipole arm 125 and 130, reduces the parasitic impact of the reflector on the antenna 100 in lower bands. In traditional dipole designs, the whole dipole and the balun radiate in the lower band as monopole and degrades the desired radiation pattern of the dipole arms. The height of the balun plus the length of dipole define the undesired resonant wavelength. When the dipole arms 125 and 130 and balun 135 are not galvanically connected as discussed herein, their undesired radiation is less destructive. Furthermore, by having the dipole arms 125 and 130 closer to the reflector, antenna gain increases due to higher current in the reflector caused by the arms being closer to the reflector. Further still, having a balun 135 which is shorter, reduces PCB use and cost when PCBs are used to implement the antenna 100.

Another advantage of the antenna design is that the capacitive coupling enables multi-band operation which allows for the interleaving of multiple dipoles to form an array of dipoles. For example, if dipole antennas using this design and operating in, for example, a mid-band band (e.g., 1695-2690 MHz) are used in an array with other dipole antennas of this deign operating in, for example, a low band (e.g., 698-896 MHZ), the dipole antennas operating in the mid band may resonate and act as parasitic mono-poles in the low band when two arrays co-exist. In a typical dipole antenna not using the capacitive coupling concept discussed herein, a dominant length (i.e., a length of the dipole antenna at which the dipole antenna radiates as a monopole) of exemplary mid-band dipoles is the length of the balun (e.g., a slotted line) plus the length of the dipole arm, which may be a length that would resonate in the low-band, thereby negatively affecting the radiation pattern of the low band antennas in the array. However, by applying the capacitive coupling concept as discussed herein, the dominant length is the balun (e.g., slotted line) length which may have a resonance frequency out of the low band, thereby not affecting the operation of the low-band antennas in the array.

Yet another benefit of the antenna design is that the capacitive coupling enables each dipole antenna 100 to have a smaller volume. The smaller volume allows arrays of these dipole antenna elements to be smaller, thereby reducing the size of the antenna array.

Multiple dipole antennas 100 can be used to make an antenna array. The dipole antennas 100 can be distributed in a line or over a planar surface. In addition, the dipole antennas 100 can be distributed over a conformal or multi-sector surface to create multi-sector or omnidirectional patterns.

Figure 2A:
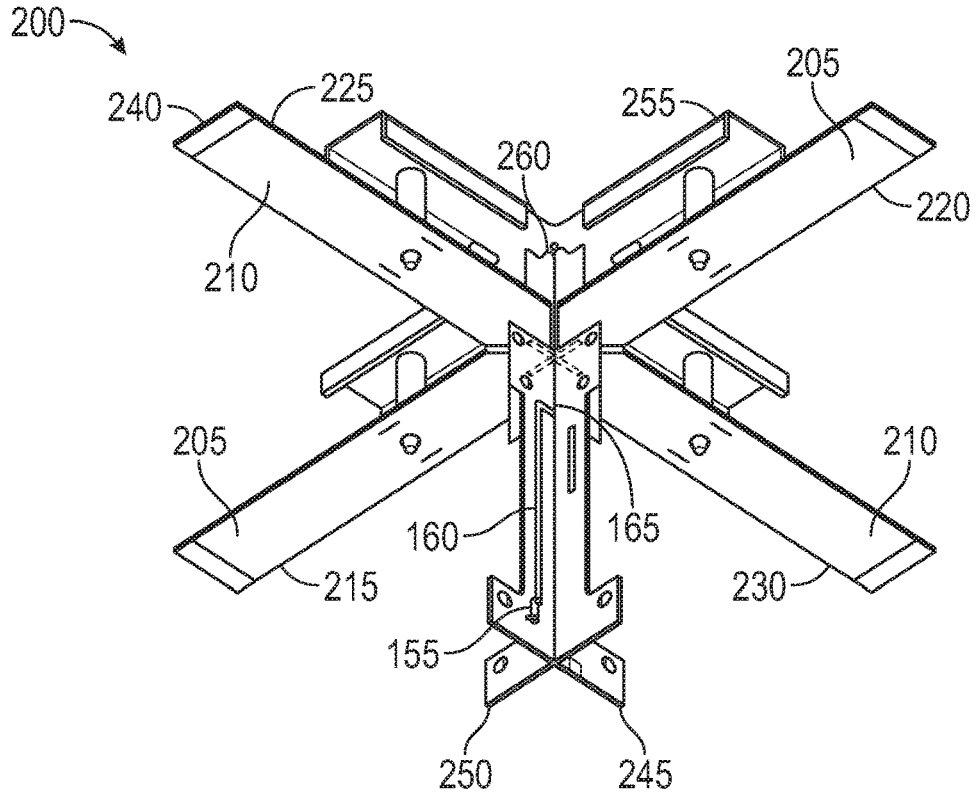
FIGS. 2A and 2B are different perspective views of an antenna, in accordance with an embodiment.
Figure 2B:
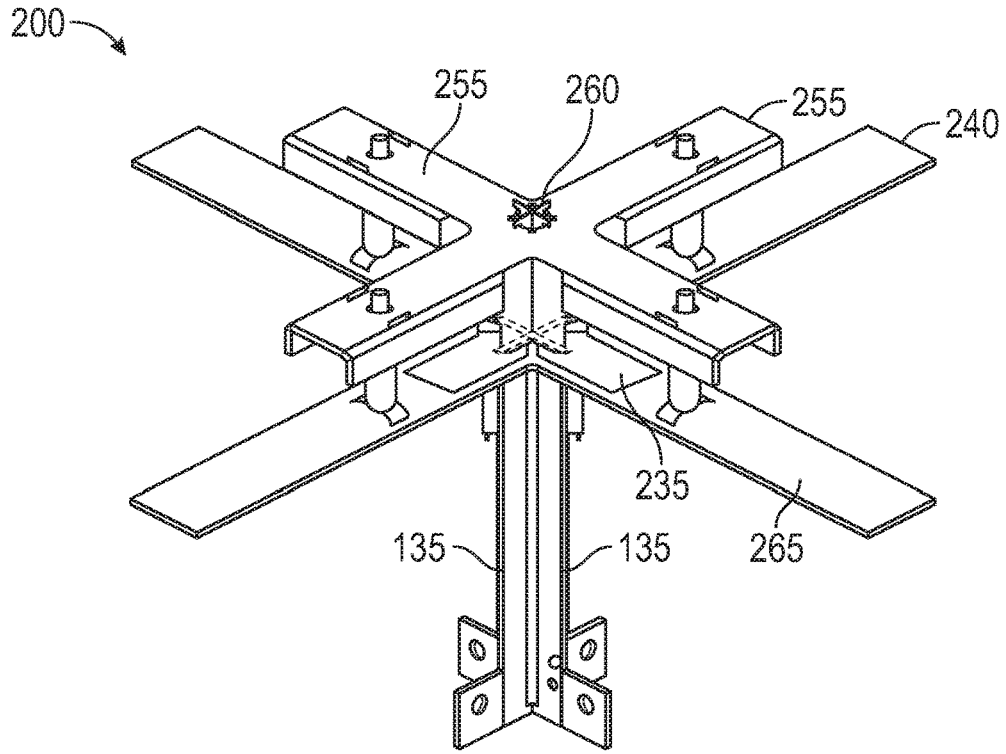

FIGS. 2A and 2B are different perspective views of an antenna 200, in accordance with an embodiment. The antenna 200 utilizes two dipoles 205 and 210 in dual-polarization format. Each of the dipoles 205 and 210 are similar to the dipole antenna 100 illustrated in FIG. 1. In practice, arrays of these antennas may be used to form, for example, cellular tower antennas, satellite communication, broadcasting, radar, or the like.

The dipole 205 includes dipole arms 215 and 220. The dipole 210 includes dipole arms 225 and 230. The dipole arms 215-230 form the main part of the antenna 200 that radiates. In one embodiment, for example, the length of the dipole arms 215-230 may be around a quarter wavelength of radiating frequency. However, the dipole arms could be designed at other resonant lengths. The antenna 200 may operate over, for example, a 617-896 MHz band. However, the frequency range of the antenna 200 can vary by adjusting the length of the dipole arms 215-230. The dipole arms 215 and 220 form one dipole radiating element having a first polarization. The dipole arms 225 and 230 form a second dipole radiating element having a second polarization normal to the polarization of the dipole formed by arms 215 and 220. Accordingly, antenna 200 is a dual-polarized antenna. The antenna 200 may have, for example, zero/ninety degree polarization, +/−forty-five degree polarization or the like.

The dipoles 205 and 210 are similar to the dipole antenna 100 illustrated in FIG. 1. However, in this embodiment, the balun 135 and the dipole arms 215-230 are formed on different substrates (e.g., different PCBs). In this embodiment, the dipole arms 215-230 and their corresponding conductive strips 235 (similar to the conductive strips 165-170 of FIG. 1) are formed on a single substrate 240, the balun 135 and transmission line 160 for the dipole 205 is formed on a substrate 245 and the balun 135 and transmission line 160 for the dipole 210 (not illustrated in the perspective view) is formed on a substrate 250. As best seen in FIG. 2B, the balun 135 for each dipole extends above the substrate 240. This allows the conductive strips 235 to be soldered to the respective balun 135, thereby galvanically connecting the conductive strips 235 to their respective balun 135 and locking the substrate 240 in place. One advantage of having the dipole arms 215-230 on a lower surface of the substrate 240 and the conductive strips 235 on the upper part of the substrate 240 is that the orientation makes it easier to solder or otherwise electrically connect the conductive strips 235 to the balun 135. However, in other embodiments, the orientation of the conductive strips 235 and the dipole arms 215-230 on the substrate 240 could be reversed.

In the embodiment illustrated in FIGS. 2A and 2B, an optional parasitic element 255 is used. The parasitic element 255 may be made from any conductive material. The parasitic element 255 can increase the bandwidth of the antenna 200 by creating multiple resonant frequencies. For example, the dipole arms 215-230 may radiate within a in lower part of the band while the parasitic element 255 may radiate within a higher part of the band. The parasitic element 255 has no galvanic connection to the antenna 200, rather, the parasitic element 255 is capacitively coupled to the dipole arms 215-230.

The substrates 245 and 250 each include a portion 260 which extends above the substrate 240. The length of the portion 260 of the substrates 245 and 250 defines a distance that the parasitic element 255 is above the dipole arms 215-230. When the substrates 240-250 are formed from PCBs, the length of the portion 260, and thus the distance that the parasitic element 255 is above the dipole arms 215-230, can be controlled with a high degree of accuracy. As a result, the amount of capacitive coupling between the parasitic element 255 and the dipole arms 215-230 can be controlled with a high degree of accuracy, improving the consistency of the performance of the antenna 200.

Figure 3:
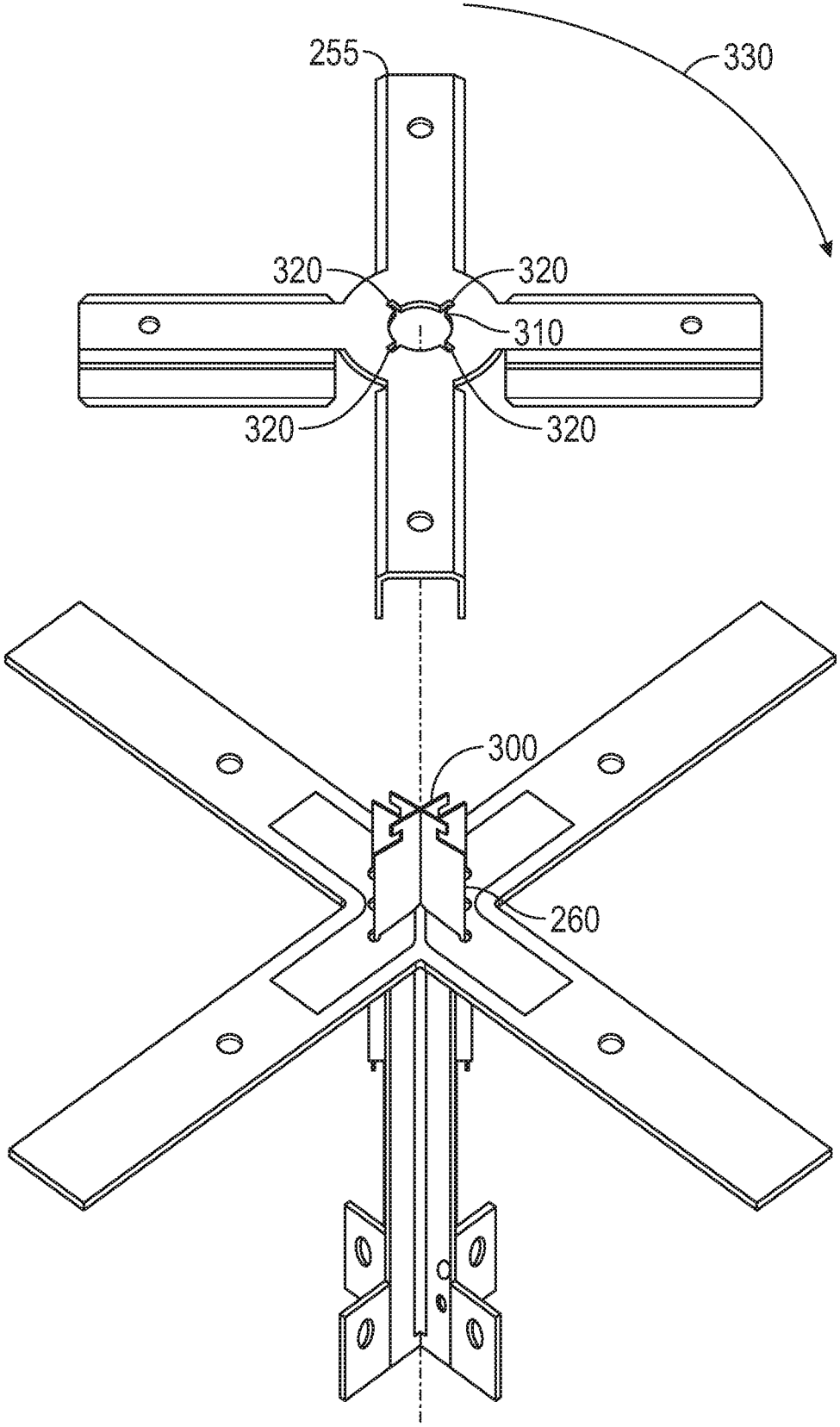
FIG. 3 is a perspective view of the antenna illustrated in FIGS. 2A-2B, in accordance with an embodiment.
Figure 4:
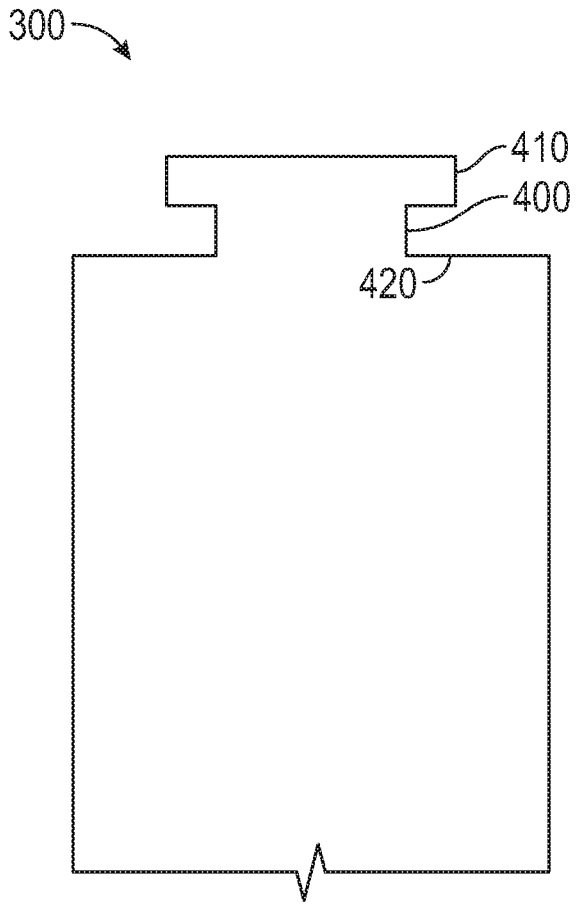
FIG. 4 is an expanded view of the locking notch for one of the substrates, in accordance with an embodiment.

The substrates 245 and 250 may further include features which lock the parasitic element 255 in place. FIG. 3 is a perspective view of the antenna 200 illustrated in FIGS. 2A-2B, in accordance with an embodiment. As seen in FIG. 3, the substrates 245 and 250 each include a locking notch 300. FIG. 4 is an expanded view of the locking notch 300 for one of the substrates, in accordance with an embodiment. As seen in FIG. 4, the locking notch 300 includes an first extension 400 of the substrate having a first width and a second extension 410 of the substrate having a second width which is wider than the first width. As discussed in further detail below, the parasitic element 255 can be locked between the second extension 410 and a lip 420 of the substrate.

Returning to FIG. 3, the parasitic element 255 defines a hole 310 having a diameter which is greater than the width of the first extension 400 of the locking notch but less than the width of the second extension 410. The parasitic element 255 further defines notches 320. The notches 320 have a width greater than the width of the second extension 410. As seen in FIG. 3, when the notches 320 of the parasitic element 255 align with the locking notch 300, the notches 320 of the parasitic element 255 align allow the parasitic element 255 to be lowered onto the substrates 240 and 245 to rest on the lip 420 of the substrate. When the parasitic element 255 element is rotated, as indicated by arrow 330, the notches 320 no longer align with the second extension 410, thereby locking the parasitic element in the vertical direction in the first extension 400 (i.e., between the second extension 410 and a lip 420 of the substrates 240 and 245).

Returning to FIG. 2, non-conductive standoffs 265 may be used to align the arms of the parasitic element 255 above the dipole arms 215-230. In one embodiment, for example, the non-conductive standoffs 265 may be formed from plastic. However, the standoffs 265 may be constructed from any non-conductive material. Another advantage of the locking notch 300 is that the parasitic element 255 can be attached to the antenna 200 without having to use glue or solder, decreasing the cost to include the optional parasitic element 255.

Figure 5:
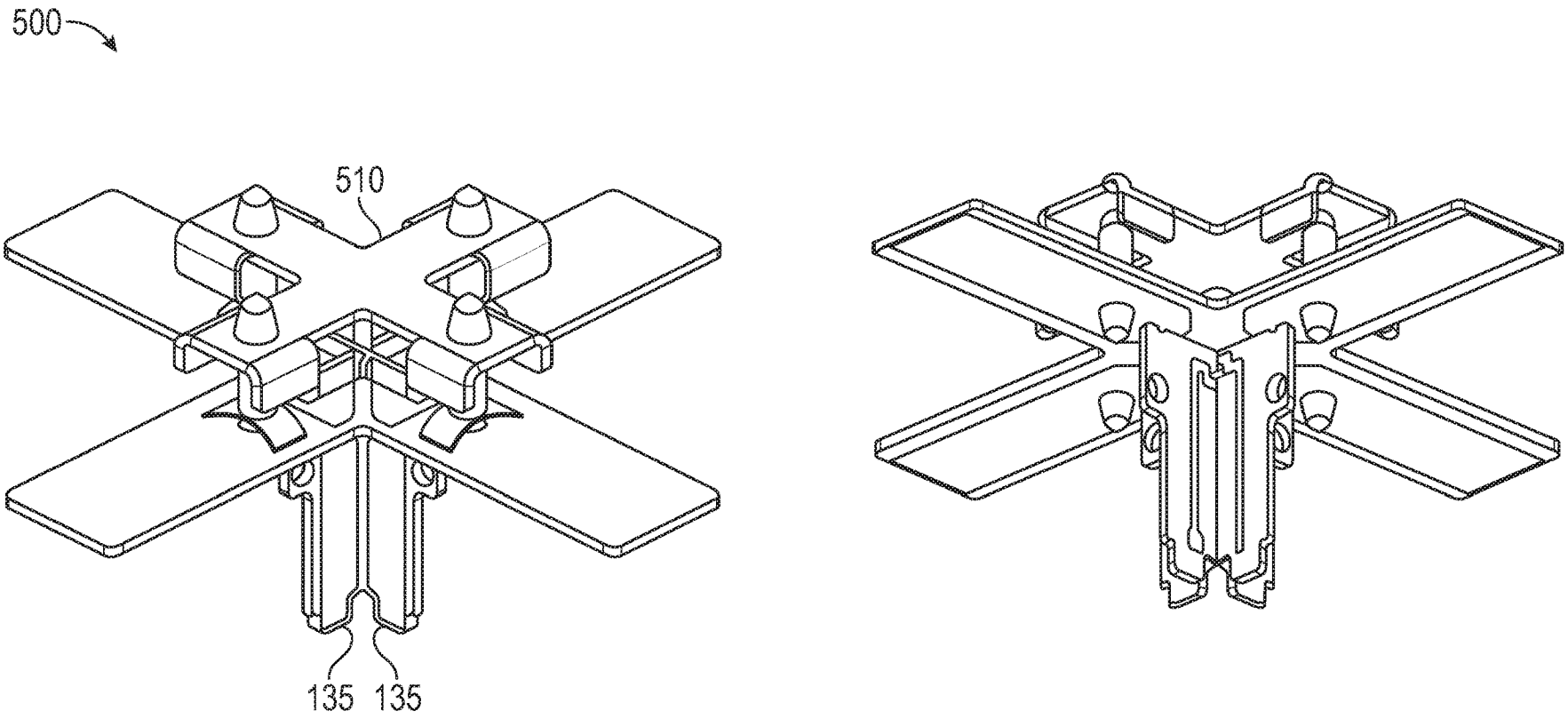
FIG. 5 is a perspective view another antenna, in accordance with an embodiment.

FIG. 5 is a perspective view another antenna 500, in accordance with an embodiment. The antenna 500 is dual-polarization dipole antenna similar to the antenna 200 illustrated in FIG. 2. The antenna 500 includes a balun 135 which is only capacitively coupled to the dipole arms in a similar manner as discussed above. The antenna 500 includes a parasitic element 510. Unlike the embodiment illustrated in FIG. 2, the parasitic element 510 is attached the antenna 500 using a combination of screws and nuts 520. Accordingly, in this embodiment, the distance of the parasitic element 510 from the dipole arms 215-230 is defined by the length of the screws.

Figure 6:
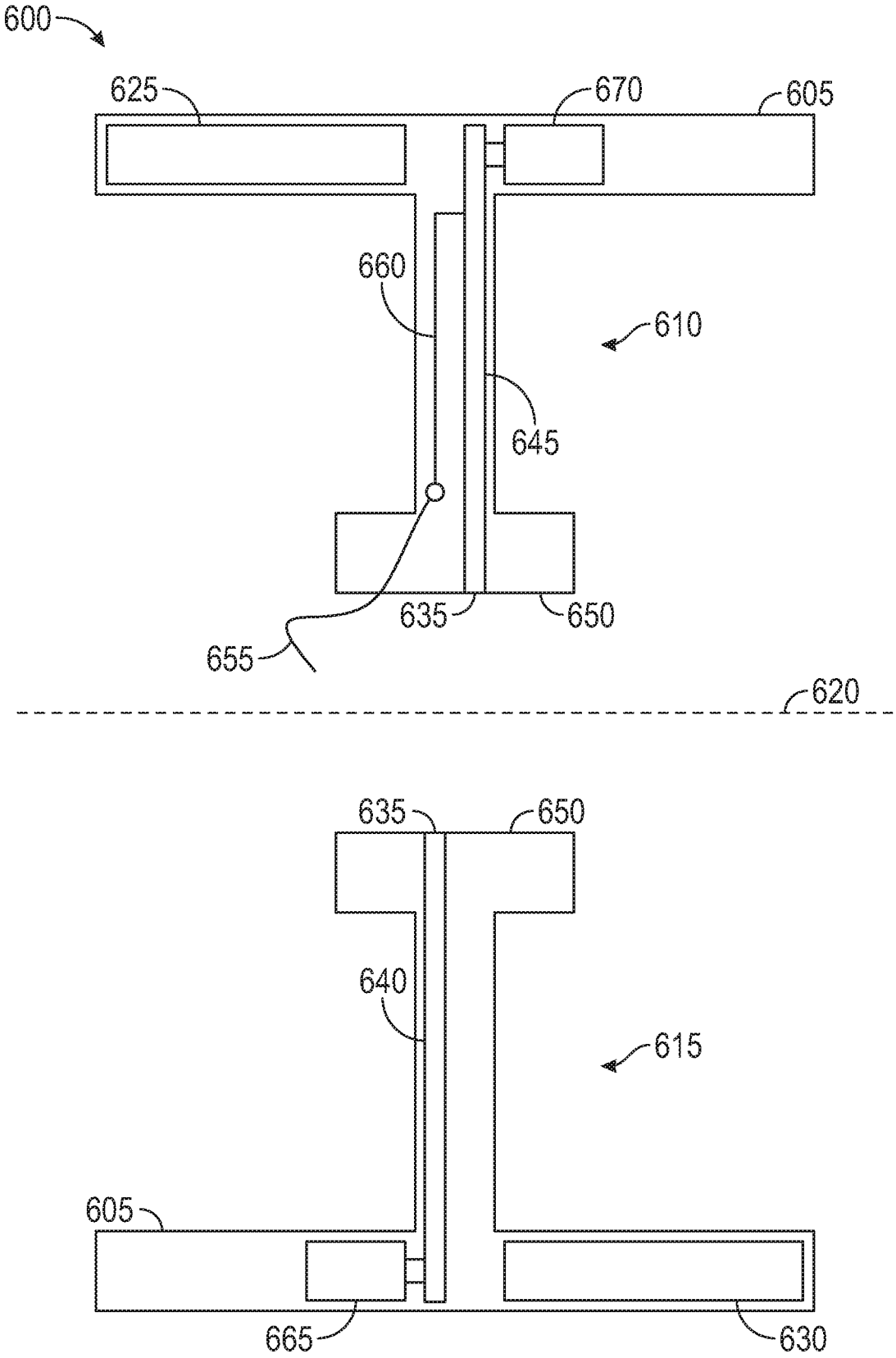
FIG. 6 illustrates another dipole antenna, in accordance with an embodiment.

FIG. 6 illustrates another dipole antenna 600, in accordance with an embodiment. The dipole antenna 600, like the dipole antenna 100, is formed on two sides of a substrate 605. In one embodiment, for example, the substrate 605 may be a printed circuit board (PCB). However, the dipole antenna 100 may be formed from any known technique, including, but not limited to metal (e.g., stamped metal antenna ort the like), coax, microstrip or the like. As seen in FIG. 6, a side 610 of the substrate 605 is illustrated on an upper half of FIG. 6 and a side 615 of the substrate 605 is illustrated on the lower half of FIG. 6. The side 615 of the substrate 605 is rotated one-hundred eighty degrees around axis 620 relative to the side 610.

The dipole antenna 600 includes a dipole arm 625 formed on the side 610 of the substrate 605 and a dipole arm 630 formed on the side 615 of the substrate 605. The length of the dipole arms 625 and 630 affect the frequency range at which the dipole antenna 600 radiates. In other words, by adjusting the length of the dipole arms 625 and 630, the dipole antenna 600 cam radiate at different frequency ranges depending upon the application of the dipole antenna 600.

The dipole antenna 600 further includes a balun 635 partially formed on both sides 610 and 615 of the substrate 605. In this embodiment the balun 635 is formed from a slotted line. In other words, the balun 635 is formed from an electrically conductive strip 640 in parallel with an electrically conductive strip 645 separated by anon-conductive material (e.g., a dielectric on a PCB). In this embodiment, the electrically conductive strip 640 is formed on the side 615 of the substrate 605 and the electrically conductive strip 645 is formed on the side 610 of the substrate 605. In the embodiment illustrated in FIG. 6, the end 650 of the dipole antenna 600 is intended to be coupled to a ground plane (not illustrated), thereby galvanically connected the respective ends of the electrically conductive strip 640 to the electrically conductive strip 645.

A feed 655, such as a coaxial cable or the like, provides a radio frequency signal to a transmission line 660 formed on the side 610 of the substrate. The transmission line 660 couples to the electrically conductive strip 645 of the balun 635.

The electrically conductive strip 640 is galvanically coupled to a conductive strip 665 arranged on an opposite side of the substrate 105 as dipole arm 125. In other words, the conductive strip 665 is positioned on a portion of the side 615 of substrate 605 which overlaps at least a portion of the dipole arm 625 on the side 610 of the substrate 105, but is galvanically isolated from the dipole arm 625 via the substrate 605 between the them. Likewise, electrically conductive strip 645 is galvanically coupled to a conductive strip 670 arranged on an opposite side of the substrate 105 as dipole arm 130. When fed a radio frequency signal from the feed 655, the conductive strips 665 and 670 capacitively couple to the dipole arms 625 and 630, respectfully, causing the dipole arms 625 and 630 to radiate. By adjusting the area of the conductive strips 665 and 670, the amount of capacitive coupling between the dipole arms 625 and 630 and the conductive strips 665 and 670 can be adjusted. This allows the reactance of the dipole arms 625 and 630 to be controlled.

The dipole antenna 600 includes all the advantages of the dipole antenna 100 illustrated in FIG. 1 by having the dipole arms 625 and 630 only being capacitively coupled to the balun 635. Additionally, because the dipole arms 625 and 630 are formed on opposite sides of the substrate 605, the transmission line 660 and the conductive strip 645 of the balun 635 can be formed on the same side of the substrate 605, side 610 illustrated in FIG. 6. Accordingly, unlike the embodiment illustrated in FIG. 1, the embodiment illustrated in FIG. 6 does not need a via to connect the transmission line 660 to the balun 635. This arrangement can reduce the cost of the dipole antenna 600 relative to the dipole antenna 100 by eliminating expensive vias from the construction cost when the substrate 605 is a PCB. Furthermore, vias may sometimes affect radio frequency performance of an antenna operating in a higher frequency range and may sometimes cause passive intermodulation. Accordingly, reducing or eliminating vias in a design has multiple advantages.

Figure 7:
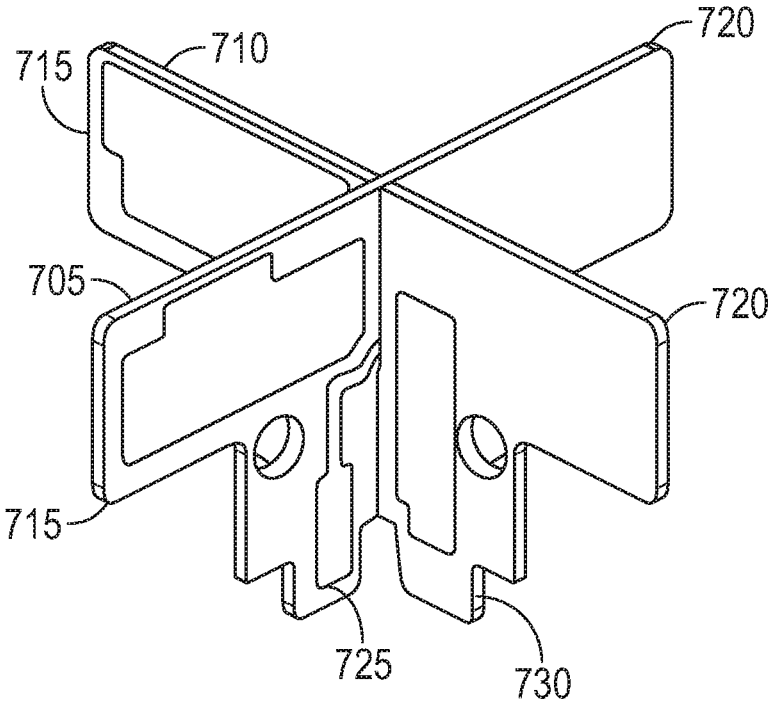
FIG. 7 is a perspective view of another antenna, in accordance with an embodiment.

FIG. 7 is a perspective view of another antenna 700 in accordance with an embodiment. The antenna 700 utilizes two dipoles 705 and 710 in dual-polarization format. In this embodiment, the antenna 700 is constructed using two dipoles similar to the dipole antenna 600 discussed in FIG. 6. Namely, the dipole arms 715 of each dipole 705 and 710 are formed on opposite sides of their respective substrates 720 allowing the respective transmission lines 725 to be connected to the respective baluns 730 without using a via as discussed above.

Furthermore, the dipole arms 715 are arranged in a vertical orientation, unlike the dipole arms 225 and 230 illustrated in FIG. 2 which are arranged in a horizontal orientation. One benefit of this embodiment is that the dipole arms 715 can be formed on the same substrate as their respective transmission lines 725 and baluns 730. This arrangement can reduce the cost of the antenna 700, relative to the antenna 200, by reducing the number of substrates needed to form the antenna 700. Furthermore, when different dipole bands are interleaved using dipoles of this configuration, there may be more space between the dipole arms, thereby resulting in less interaction between the dipole elements. However, the arrangement of the dipole arms 715 could also be implemented in the same orientation and configuration illustrated in FIG. 2 (i.e., horizontally orientated dipole arms on a separate substrate).

Figure 8:
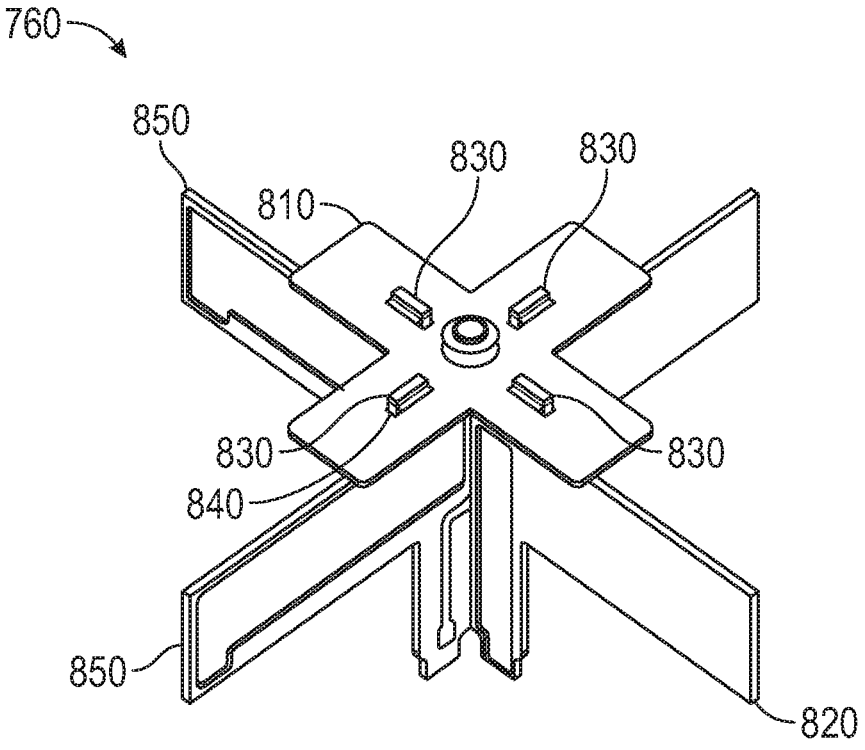
FIG. 8 is a perspective view of yet another antenna, in accordance with an embodiment.

FIG. 8 is a perspective view of yet another antenna 800, in accordance with an embodiment. In particular, FIG. 8 illustrates an antenna 800 which is similar to the antenna 700 illustrated in FIG. 7, but further includes a parasitic element 810. As seen in FIG. 8, a substrate 820, such as the dielectric portion of a PCB, includes vertically extending tabs 830. The vertically extending tabs 830 pass through corresponding slits 840 in the parasitic element 810 and align the parasitic element 810 with the dipole arms 850 of the antenna 800. While the substrate 820 in FIG. 8 includes four vertically extending tabs 830, the substrate 820 may have one, two, three or four tabs.

By optimizing the dimensions of the parasitic element 810 and its location, the bandwidth of the antenna 800 can be increased. The parasitic element 810 has no galvanic connection to the dipole arms 850. In the embodiment illustrated in FIG. 8, the parasitic element 810 is held in place by a plastic screw or rivet 860.

Figure 9:
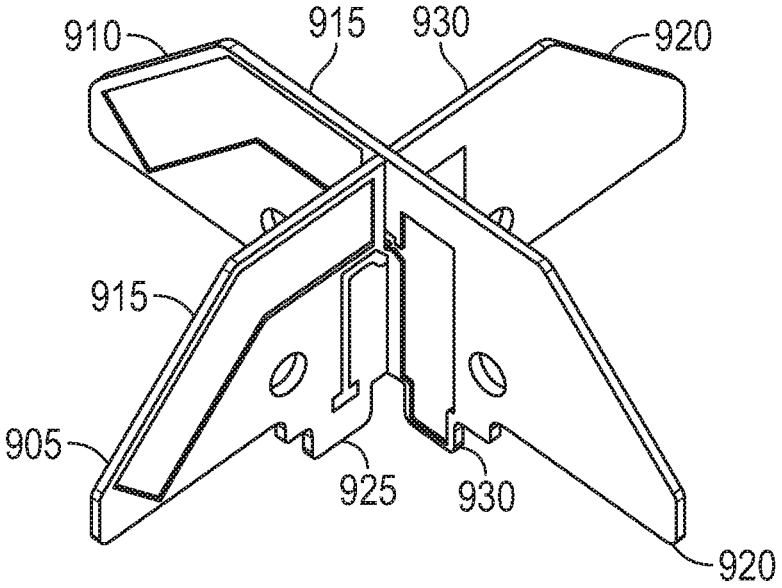
FIG. 9 is a perspective view of another antenna, in accordance with an embodiment.

FIG. 9 is a perspective view of another antenna 900, in accordance with an embodiment. The antenna 900 utilizes two dipoles 905 and 910 in dual-polarization format. The antenna 900 is constructed using two dipoles similar to the dipole antenna 600 discussed in FIG. 6. Namely, the dipole arms 915 of each dipole 905 and 910 are formed on opposite sides of their respective substrates 920 allowing the respective transmission lines 925 to be connected to the respective baluns 930 without using a via as discussed above. Furthermore, like all of the antennas discussed herein, the baluns 930 of the antenna 900 are only capacitively coupled to the dipole arms.

In the embodiment illustrated in FIG. 9, the dipole arms 915 (i.e., the radiating portion) are bent. By bending the dipole arms 915, the effective electrical length of the dipole arms 915, which controls the radiating frequency, can be increased without a corresponding increase to the actual length of the dipole arms 915. In other words, a dipole arm which is bent has a longer electrical length than a dipole arm which is not bent. This allows the antenna 900 to be smaller than corresponding antennas which do not utilize bent dipole arms 915.

While numerous embodiments are illustrated herein, any of the features from any of the antennas discussed herein may be used in any combination. In other words, any combination of the dipole configurations, the parasitic elements, and the mounting mechanisms may be used.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A dipole antenna, comprising: a first transmission line configured to receive a radio frequency signal from a first feed; a first balun galvanically coupled to the first transmission line; a first conductive strip galvanically coupled to the first transmission line and the first balun; a second conductive strip galvanically coupled to the first transmission line and the first balun; a first dipole arm; a second dipole arm, wherein the first balun and the first transmission line are only capacitively coupled to the first and second dipole arms via the first and second conductive strips; a second transmission line configured to receive a radio frequency signal from a second feed; a second balun galvanically coupled to the second transmission line; a third conductive strip galvanically coupled to the second transmission line and the second balun; a fourth conductive strip galvanically coupled to the second transmission line and the second balun; a third dipole arm; a fourth dipole arm; a parasitic element capacitively coupled to the first, second, third and fourth dipole arms; and a locking notch; wherein the parasitic element is locked on the locking notch by rotating the parasitic element on the locking notch, and wherein the second balun and the second transmission line are only capacitively coupled to the third and fourth dipole arms via the third and fourth conductive strips, and the first dipole arm and the second dipole arm have a first polarization and the third dipole arm and fourth dipole arm have a second polarization different than the first polarization.

2. The dipole antenna of claim 1, further comprising a substrate having a first side and a second side, wherein the first dipole arm and the second dipole arm a situated on the first side of the substrate and the first conductive strip and the second conductive strip are situated on the second side of the substrate.

3. The dipole antenna of claim 2, wherein the first transmission line is situated on the first side of the substrate and the first balun is situated on the second side of the substrate, wherein the first transmission line is galvanically coupled to the first balun through a via.

4. The dipole antenna of claim 1, further comprising a substrate having a first side and a second side, wherein the first dipole arm and the second dipole arm a situated on the first side of the substrate and the first conductive strip and the second conductive strip are situated on the second side of the substrate.

5. A dipole antenna, comprising:

a first transmission line configured to receive a radio frequency signal from a first feed;

a first balun galvanically coupled to the first transmission line;

a first conductive strip galvanically coupled to the first transmission line and the first balun;

a second conductive strip galvanically coupled to the first transmission line and the first balun;

a first dipole arm;

a second dipole arm; and a substrate having a first side and a second side;

wherein the first dipole arm and the second dipole arm a situated on the first side of the substrate and the first conductive strip and the second conductive strip are situated on the second side of the substrate, wherein the first balun and the first transmission line are only capacitively coupled to the first and second dipole arms via the first and second conductive strips, wherein the first balun comprises a slotted line having a first strip and a second strip separated by a non-conductive material, and wherein the first strip of the slotted line is situated on the second side of the substrate and is galvanically coupled to the first conductive strip, and the second strip of the slotted line is situated on the first side of the substrate and is galvanically coupled to the second conductive strip.

6. The dipole antenna of claim 5, wherein the first transmission line is situated on the first side of the substrate and is galvanically coupled to the second strip of the slotted line.

7. The dipole antenna of claim 5, further comprising:

a second transmission line configured to receive a radio frequency signal from a second feed;

a second balun galvanically coupled to the second transmission line;

a third conductive strip galvanically coupled to the second transmission line and the second balun;

a fourth conductive strip galvanically coupled to the second transmission line and the second balun;

a third dipole arm; and a fourth dipole arm, wherein the second balun and the second transmission line are only capacitively coupled to the third and fourth dipole arms via the third and fourth conductive strips, and the first dipole arm and the second dipole arm have a first polarization and the third dipole arm and fourth dipole arm have a second polarization different than the first polarization.

8. The dipole antenna of claim 7, further comprising a parasitic element capacitively coupled to the first, second, third and fourth dipole arms.

9. The dipole antenna of claim 8, further comprising a locking notch, wherein the parasitic element is locked on the locking notch by rotating the parasitic element on the locking notch.

10. The dipole antenna of claim 9, wherein the substrate is a printed circuit board.

11. The dipole antenna of claim 7, wherein the substrate has a first side and a second side, wherein the first dipole arm, the second dipole arm, the third dipole arm and the fourth dipole arm are situated in the first side of the substrate, and the first conductive strip, the second conductive strip, the third conductive strip and the fourth conductive strip are situated on the second side of the substrate.

12. A dipole antenna, comprising:

a first transmission line configured to receive a radio frequency signal from a first feed;

a first balun galvanically coupled to the first transmission line;

a first conductive strip galvanically coupled to the first transmission line and the first balun;

a second conductive strip galvanically coupled to the first transmission line and the first balun;

a first dipole arm;

a second dipole arm, wherein the first balun and the first transmission line are only capacitively coupled to the first and second dipole arms via the first and second conductive strips;

a second transmission line configured to receive a radio frequency signal from a second feed;

a second balun galvanically coupled to the second transmission line;

a third conductive strip galvanically coupled to the second transmission line and the second balun;

a fourth conductive strip galvanically coupled to the second transmission line and the second balun;

a third dipole arm;

a fourth dipole arm;

wherein the second balun and the second transmission line are only capacitively coupled to the third and fourth dipole arms via the third and fourth conductive strips;

wherein the first dipole arm and the second dipole arm have a first polarization and the third dipole arm and fourth dipole arm have a second polarization different than the first polarization; and further comprising a first substrate having a first side and a second side, wherein the first dipole arm and the second conductive strip are situated in the first side of the first substrate, and the second dipole arm and the first conductive strip are situated on the second side of the first substrate; and a second substrate having a first side and a second side, wherein the third dipole arm and the fourth conductive strip are situated in the first side of the second substrate, and the fourth dipole arm and the third conductive strip are situated on the second side of the second substrate.

13. A dual polarized antenna, comprising: a first dipole antenna, comprising: a first transmission line configured to receive a radio frequency signal from a first feed; a first balun galvanically coupled to the first transmission line; a first conductive strip galvanically coupled to the first transmission line and the first balun; a second conductive strip galvanically coupled to the first transmission line and the first balun; a first dipole arm; and a second dipole arm, wherein the first balun and the first transmission line are only capacitively coupled to the first and second dipole arms via the first and second conductive strips; and a second dipole antenna, comprising: a second transmission line configured to receive a radio frequency signal from a second feed; a second balun galvanically coupled to the second transmission line; a third conductive strip galvanically coupled to the second transmission line and the second balun; a fourth conductive strip galvanically coupled to the second transmission line and the second balun; a third dipole arm; and a fourth dipole arm, a parasitic element capacitively coupled to the first, second, third and fourth dipole arms; and a locking notch; wherein the parasitic element is locked on the locking notch by rotating the parasitic element on the locking notch, wherein the second balun and the second transmission line are only capacitively coupled to the third and fourth dipole arms via the third and fourth conductive strips, and wherein the first dipole arm and the second dipole arm have a first polarization and the third dipole arm and fourth dipole arm have a second polarization different than the first polarization.

14. The dual polarized antenna according to claim 13, further comprising a first substrate having a first side and a second side, wherein the first dipole arm, the second dipole arm, the third dipole arm, and the fourth dipole arm are situated on the first side of the first substrate and the first conductive strip, the second conductive strip, the third conductive strip, and the fourth conductive strip are situated on the second side of the first substrate.

15. The dual polarized antenna according to claim 14, further comprising:

a second substrate wherein the first transmission line is situated on the first side of the second substrate and the first balun is situated on the second side of the second substrate, wherein the first transmission line is galvanically coupled to the first balun through a via; and a third substrate wherein the second transmission line is situated on the first side of the third substrate and the second balun is situated on the second side of the third substrate, wherein the second transmission line is galvanically coupled to the second balun through a via.

16. A dual polarized antenna, comprising:

a first dipole antenna, comprising:

a first transmission line configured to receive a radio frequency signal from a first feed;

a first balun galvanically coupled to the first transmission line;

a first conductive strip galvanically coupled to the first transmission line and the first balun;

a second conductive strip galvanically coupled to the first transmission line and the first balun;

a first dipole arm; and a second dipole arm, wherein the first balun and the first transmission line are only capacitively coupled to the first and second dipole arms via the first and second conductive strips; and a second dipole antenna, comprising:

a second transmission line configured to receive a radio frequency signal from a second feed;

a second balun galvanically coupled to the second transmission line;

a third conductive strip galvanically coupled to the second transmission line and the second balun;

a fourth conductive strip galvanically coupled to the second transmission line and the second balun;

a third dipole arm;

a fourth dipole arm;

a first substrate having a first side and a second side, wherein the first dipole arm and the second conductive strip are situated on the first side of the first substrate and the second dipole arm and the first conductive strip are situated on the second side of the first substrate; and a second substrate having a first side and a second side, wherein the third dipole arm and the fourth conductive strip a situated on the first side of the second substrate and the fourth dipole arm and the third conductive strip are situated on the second side of the second substrate.

17. The dual polarized antenna according to claim 16, wherein the first balun comprises a slotted line having a first strip and a second strip, wherein first strip of the slotted line is situated on the second side of the first substrate and is galvanically coupled to the first conductive strip, and the second strip of the slotted line is situated on the first side of the first substrate and is galvanically coupled to the second conductive strip, and wherein the second balun comprises a second slotted line having a first strip and a second strip, wherein first strip of the second slotted line is situated on the second side of the second substrate and is galvanically coupled to the third conductive strip, and the second strip of the second slotted line is situated on the first side of the second substrate and is galvanically coupled to the fourth conductive strip.

18. The dipole antenna of claim 17, wherein the first transmission line is situated on the first side of the first substrate and is galvanically coupled to the second strip of the first slotted line and the second transmission line is situated on the first side of the second substrate and is galvanically coupled to the second strip of the second slotted line.

* * * * *